US006098340A

United States Patent [19]

Francis

[11] Patent Number: 6,098,340

[45] Date of Patent: Aug. 8, 2000

[54] LOUVRE WINDOW ASSEMBLY

[75] Inventor: Michael Gerrard Francis, Upper Hutt, New Zealand

[73] Assignee: Interlock Group Limited, New Zealand

[21] Appl. No.: 09/139,881

[22] Filed: Aug. 25, 1998

[30] Foreign Application Priority Data

Sep. 12, 1997 [NZ] New Zealand ..... 328726

[51] Int. Cl.[7] ..... E06B 7/08

[52] U.S. Cl. ..... 49/74.1; 49/403

[58] Field of Search ..... 49/64, 74.1, 79.1, 49/87.1, 90.1, 403

[56] References Cited

U.S. PATENT DOCUMENTS

| | | | |
|---|---|---|---|
| 2,760,242 | 8/1956 | Armstrong | 49/403 |
| 3,205,541 | 9/1995 | Beards | 49/403 |
| 3,375,608 | 4/1968 | Thompson | 49/403 |
| 4,226,051 | 10/1980 | Thompson | 49/403 |
| 5,630,295 | 5/1997 | Neiman | 49/403 |
| 5,794,380 | 8/1998 | Guardia | 49/74.1 |

FOREIGN PATENT DOCUMENTS

| | | | |
|---|---|---|---|
| 2090965 | 10/1981 | United Kingdom | F24F 13/14 |
| 2285123 | 6/1995 | United Kingdom . | |

*Primary Examiner*—Daniel P. Stodola
*Assistant Examiner*—Curtis A. Cohen
*Attorney, Agent, or Firm*—Blakely, Sokoloff, Taylor & Zafman

[57] ABSTRACT

A louvre blade assembly of a louvre window. A plurality of louvre blade mounts (20) are rotatably mounted to a mullion (10). Control bars (14) within the mullion are operable by a handle (11). The control bars (14) are selectively movable to be moved to a removal position which is beyond the extremes of the normal extent of movement between open and closed positions so that one or more of the blade mounts (20) can be removed from the mullion (10). The control bars (14) can be prevented from moving to the removal position by a limit device located in an opening (26) in the mullion (10).

12 Claims, 5 Drawing Sheets

LOUVRE WINDOW ASSEMBLY

BACKGROUND OF THE INVENTION

This invention relates to improvements in louvre windows.

A louvre window typically consists of a pair of opposed mullions each mounting a plurality of blade mounts between which extend louvre blades usually made of glass. One louvre assembly is controlled, ie a handle operatively connected with control bars connected with the blade mounts is provided for movement of the blade mounts between open and closed positions. The other louvre assembly is non controlled, ie the louvre mounts are simply mounted for movement between open and closed positions, such movement being effected by movement of the louvre blades as controlled by the controlled louvre assembly.

Louvre blade mounts can become damaged as a result of, for example, abuse or vandalism thereby requiring replacement of the blade mount. Replacement of the blade mount in the non-controlled louvre assembly can be carried out relatively easily by simply removing the louvre blade adjacent the damaged mount. The damaged blade mount can then be simply pulled out and a new mount snapped into place.

However, when a blade mount needs to be replaced in the controlled louvre assembly this requires all of the louvre blades to be removed and then the complete mullion with blade mounts taken out of position for dismantling. At the completion of dismantling of the assembly the replacement blade mount can be fitted and the reverse procedure then followed to complete reinstallation.

Quite often it is difficult to remove the controlled louvre assembly. This is due, for example, to the mullion having been embedded in cementitious or plaster material or other structural material during finishing of the building structure. Therefore, not only is removal of the controlled louvre assembly time-consuming, it can necessitate structural work in order to achieve removal of the mullion to permit dismantling of the assembly to take place.

SUMMARY OF THE INVENTION

An object of the present invention is thus to provide a louvre blade mount assembly whereby a blade mount can be removed without dismantling of the assembly being necessary.

According to one broad aspect of the invention, there is provided a louvre blade assembly including a mullion and a plurality of blade mounts rotatably mounted therewith, there being control bars within the mullion operably connected to the blade mounts, said control bars being operable by an externally accessible handle, the blade mount assembly being characterised by the control bars being selectively movable to cause the blade mounts to be moved to a removal position which is beyond the extremes of normal extent of movement between open and closed positions whereby one or more of the blade mounts can be removed from the mullion.

DESCRIPTION OF THE PREFERRED EMBODIMENTS

Figure 1:
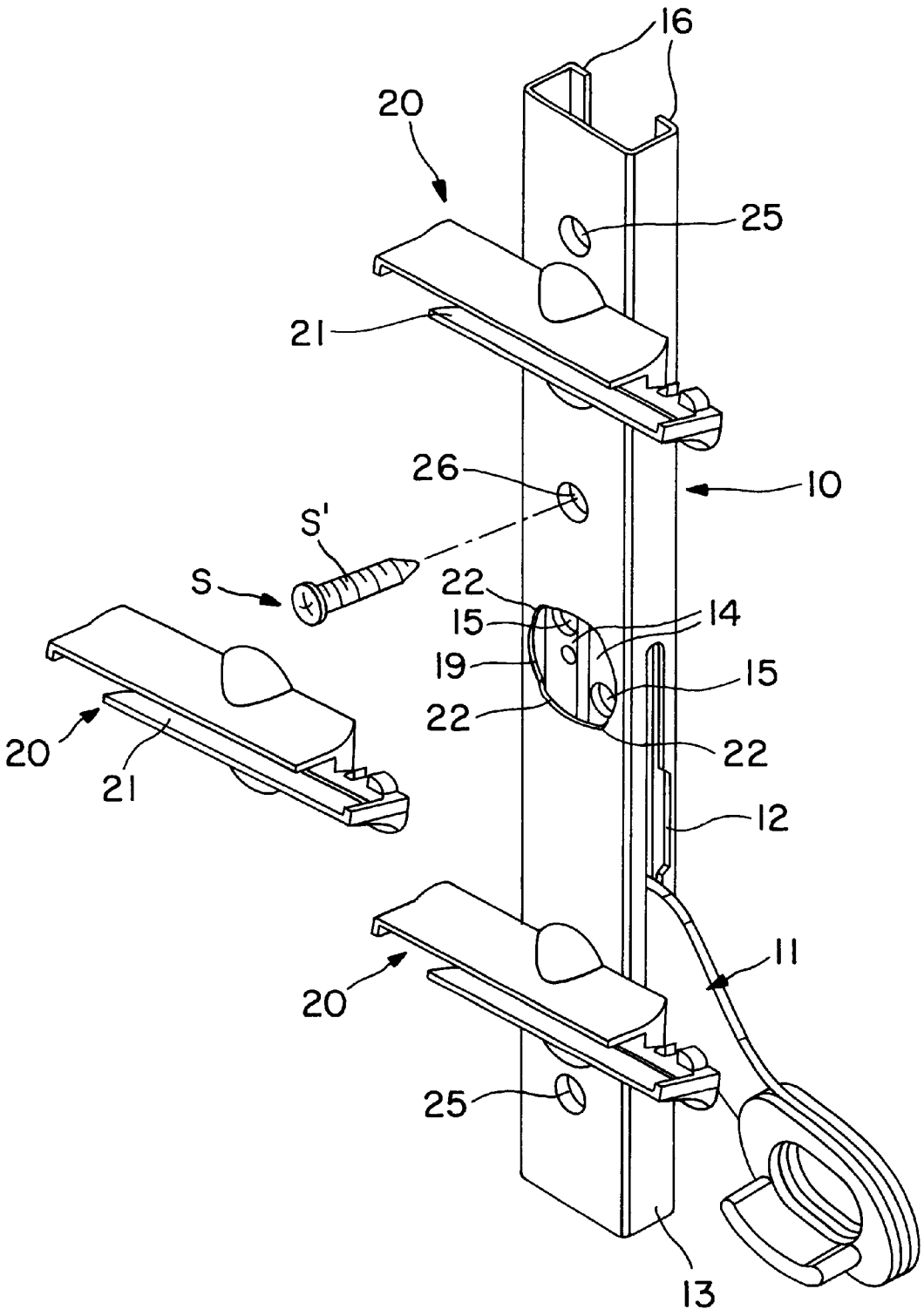
FIG. 1 is an isometric view of the louvre blade mount assembly with the blade mounts being located in a removal position whereby the blade mounts can be removed from the mullion.

The louvre blade assembly as illustrated in the drawings is generally of the type disclosed and claimed in our British patent specification 2090965 with the louvre blade mounts being of the type disclosed and claimed in our British patent specification 2285123. The content of the aforementioned patent specifications is therefore incorporated herein by way of specific reference.

Figure 6:
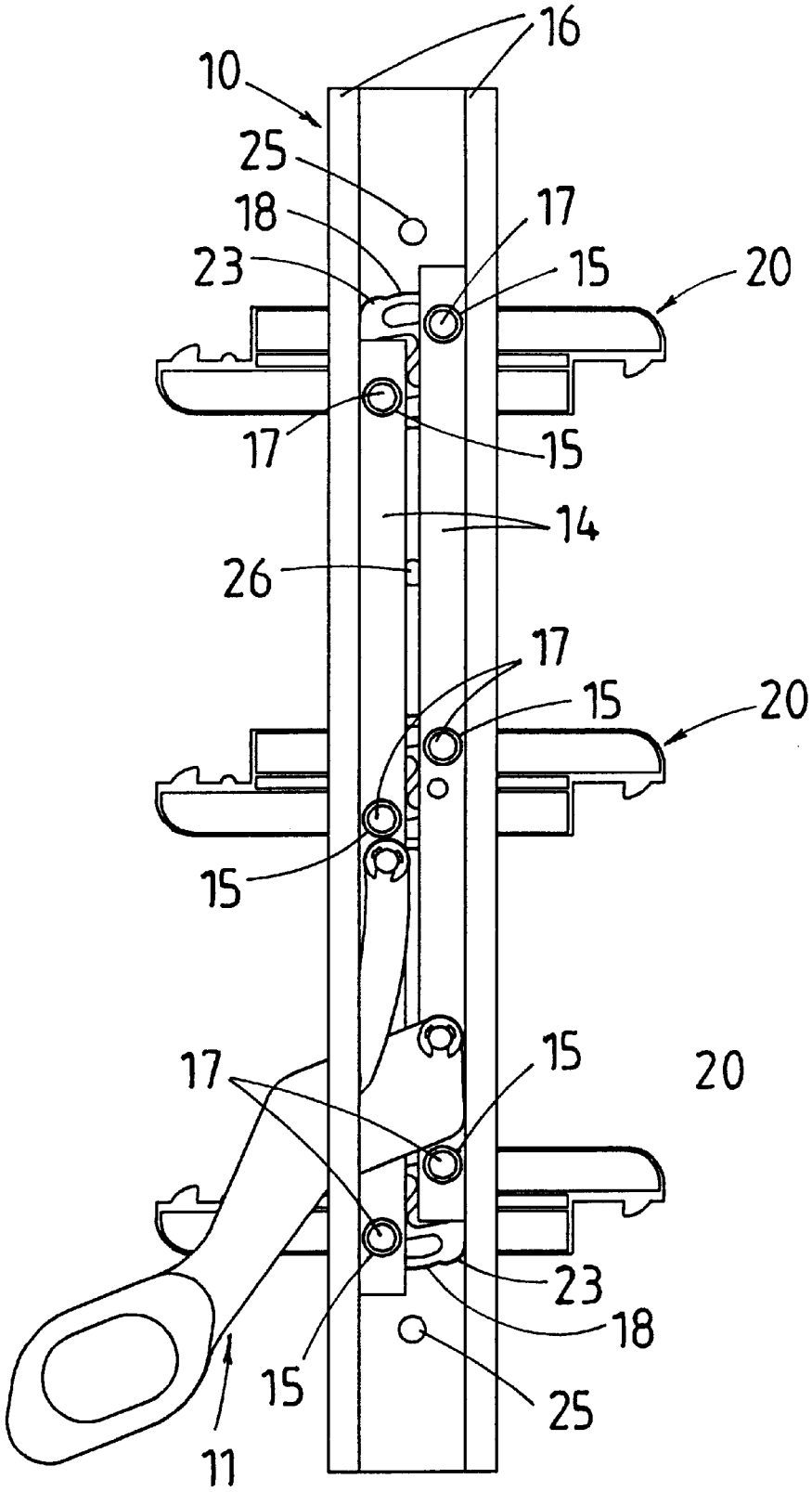
FIG. 6 is a rear elevation view of the assembly as shown in FIG. 5.

As shown in FIG. 1, the louvre blade mount assembly comprises a mullion 10 having a handle 11 projecting through a slot 12 extending longitudinally along part of one wall 13 of the channel shaped mullion 10. As illustrated in FIG. 6 and described in the aforesaid patent specifications, the handle 11 is operatively coupled to a pair of control bars 14 which extend longitudinally within the channel shaped mullion 10. These control bars 14 are substantially L-shaped with one leg having a plurality of openings 15 and the other leg slidingly engaging with or terminating adjacent to the return 16 extending inwardly from each wall 13 of the channel-shaped mullion 10.

As mentioned previously, the blade mount is preferably of a general type disclosed in our British patent specification 2285123 and therefore includes a pair of bosses 17 which rotatably engage in openings 15 in control bars 14. These bosses 17 project from a pivoting boss 18 which rotatably locates in opening 19 in the mullion 10.

With handle 11 located at one end of slot 12 (for ease of reference, this being the lower end of slot 12 when the assembly is viewed as shown in the drawings) the control bars 14 are moved to their closest approach. A louvre mount 20 can thus be installed by inserting pivoting boss 18 through opening 19 so that the driving bosses 17 push into location in openings 15. As illustrated, the length of the louvre blade mounting channel 21 of the blade mount 20 is substantially at right angles to the length of the mullion 10.

Figure 2:
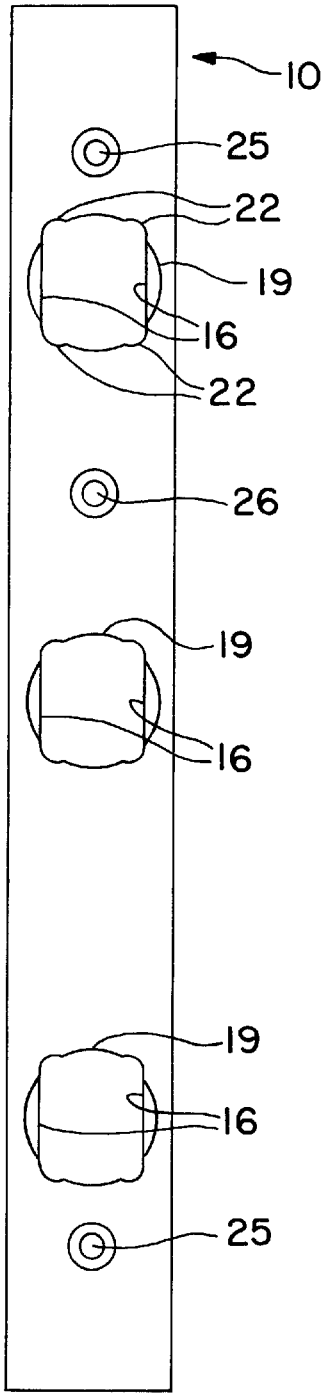
FIG. 2 is a front elevation view of the mullion.
Figure 3:
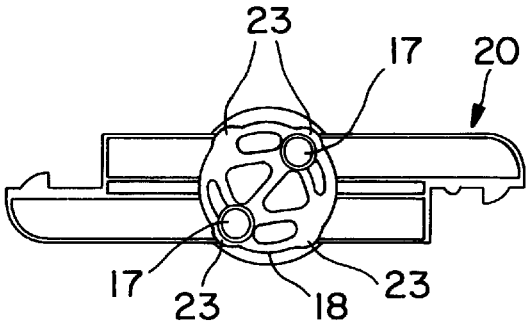
FIG. 3 is a rear elevation view of a blade mount.
Figure 4:
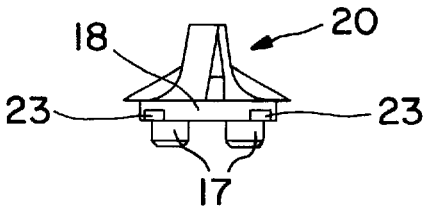
FIG. 4 is an end elevation view of a blade mount.

According to the present invention and referring to FIGS. 1 and 2, opening 19 is basically circular but has a plurality of spaced arcuate recesses or notches 22. As can be seen in FIG. 2, the notches are symmetrical about a centre line, however, the angles between the notches are not the same. The pivoting boss 18 of the louvre mount 20 has a similar plurality of identically spaced lugs 23. These lugs 23 (which preferably are of a shape commensurate with notches 22) engage through notches 22 when the driving boss 18 is inserted into opening 19. As can be seen in FIG. 4, the lugs 23 are each spaced from the underside of pivoting boss 18 by a distance slightly greater than the thickness of the floor of the channel-shaped mullion 10.

Figure 7:
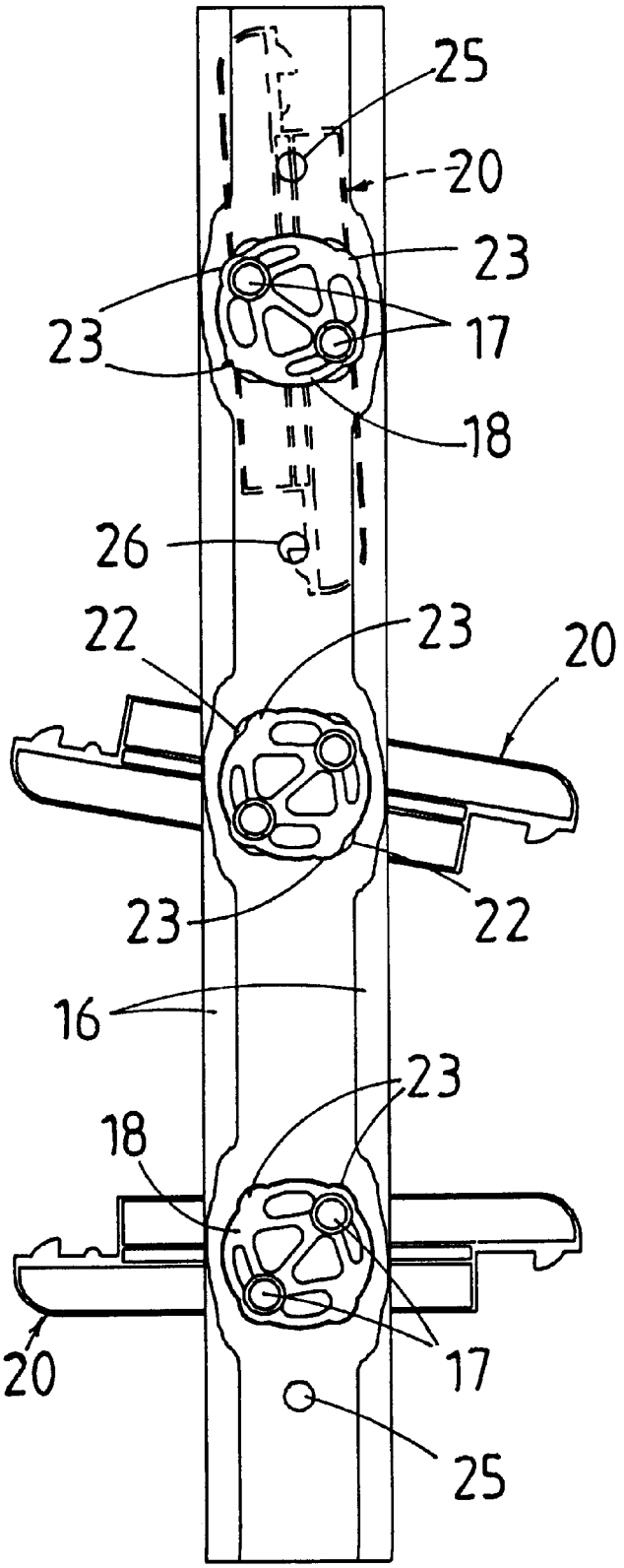
FIG. 7 is a rear elevation view of the assembly with the handle and control bars removed and showing the blade mounts in different positions with the uppermost blade mount in the fully closed position, the middle blade mount in the fully open position and the lowermost blade mount in the removal position.

When all blade mounts 20 are located in position, handle 11 can be moved along slot 12 so the control bars move apart. Once the handle 11 approaches the other or upper end of the slot 12, the louvre blades are moved into a closed position, i.e. the position shown in dotted detail in the upper blade mount 20 illustrated in FIG. 7.

Once handle 11 has moved slightly from its lower position the plurality of lugs 23 are rotated from their alignment with notches 22 so that the lugs 23 are located in sliding engagement with the inner surface of the floor of the channel 10. This initial non-alignment of the lugs 23 with notches 22 corresponds with the fully open position of the blade mount 20 as shown by the middle blade mount 20 in FIG. 7.

During rotation of the blade mount 20 to the fully closed position, all four of the lugs 23 never again become aligned with the four notches 22. It will be seen, for example, that in the fully closed position each lug 23 approaches or exceeds but does not overlap the notches 22. Accordingly, during normal movement of the blade mounts between the fully open and fully closed positions only two lugs 23 and two notches 22 ever become aligned. Consequently, during normal operation of the louvre assembly a blade mount 20 cannot be removed from the assembly.

Figure 5:
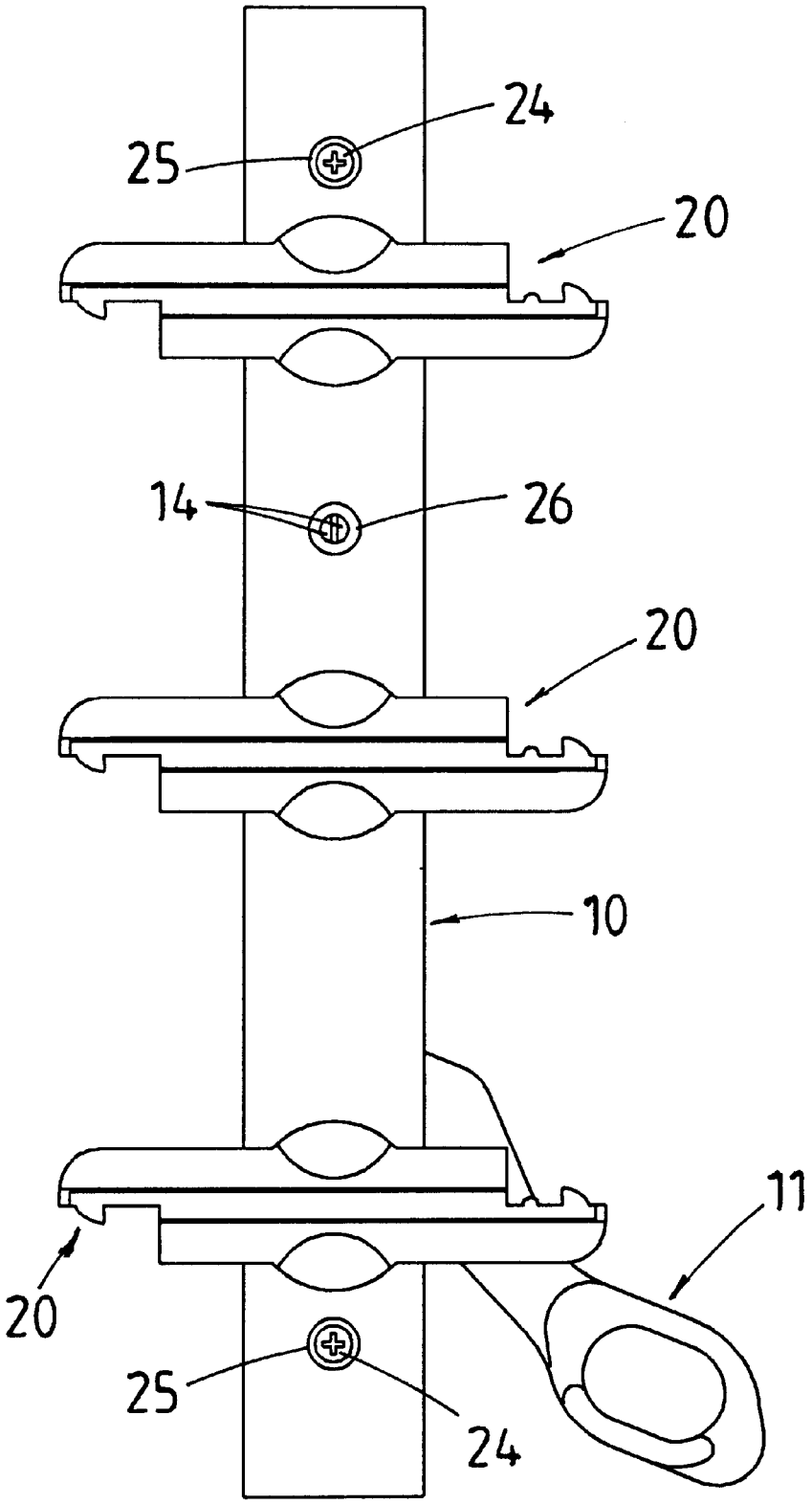
FIG. 5 is a front elevation view of the louvre blade mount assembly in the removal position where removal of blade mounts is possible.

FIG. 5 shows the louvre blade assembly in a mounted position where top and bottom fixing screws 24 are engaged through openings 25 in the floor of the channel 10 to fix the mullion to the window frame. As can be seen in FIG. 6, the fixing screws 24 when engaged through openings 25 are clear of and therefore do not interfere in the movement of the control bars.

Normally, a further fixing screw S (see FIG. 1) would be inserted through intermediate opening or openings 26. The presence of the shank S of such a screw S extending through the opening 26 and into the frame structure to which the channel 10 is mounted will prevent the control bars 14 being moved by handle 11 to their closest approach (e.g. as shown in FIGS. 5 and 6), ie with the blade mounts located substantially at right angles to the length of the channel 10.

However, once the fixing screw S or screws through opening(s) 26 has/have been removed (see FIG. 5) the handle 11 can be pushed fully down to the bottom of the slot 12 thereby bringing the control bars 14 to their closest approach resulting in the blade mounts 20 being moved to a position slightly beyond the fully open position, ie the removal position. In this position all four of the lugs 23 and all four of the notches 22 are aligned thereby permitting one or more of the blade mounts 20 to be removed without any other dismantling of the louvre blade assembly and more particularly removal of the mullion from its structural mounting.

Consequently, if a blade mount becomes damaged all but the top and bottom mullion fixing screws 25 are removed and the handle 11 pushed down to its lowermost position thereby allowing the blade mounts to become horizontal to the vertical mullion. With the louvre blade having been removed, it is then a simple matter of pulling the damaged blade mount away from the mullion and replacing it with a new blade mount. The handle is then pushed up just enough to allow the fixing screws to be refitted and replacement of the louvre blade to take place.

The invention is open to modification. For example, separate limit means can be used to limit the movement of the control bars so that the removal position cannot be readily achieved. This could be a removal or adjustable abutment which engages with handle 11 so that it cannot normally reach the lowermost position in slot 12. The abutment could equally engage with one or other of control bars 14. In one form a plug could be inserted through an opening 26 to perform the same limiting function as a fixing screw or fastener.

Also, other means of retaining the pivoting boss 18 in opening 19 other than at the removal position could be employed.

The present invention therefore provides ease of blade mount replacement without removal and dismantling of the louvre blade mount assembly.

What is claimed is:

1. A louvre blade assembly, comprising:

a mullion with a plurality of openings;

a plurality of control bars moveably mounted within the mullion;

a plurality of louvre blade mounts, each louvre blade mount having a projection removeably coupled to at least one of said control bars, wherein each projection is mounted within a respective opening in the mullion so as to rotate about an axis of rotation;

an operating handle operatively coupled to at least one of the plurality of control bars so as to be movable between a first position which corresponds to the louvre blade mounts being located in a closed position and a second position which corresponds to the louvre blade mounts being located in a fully open position;

a releasable limit device in operative communication with the operating handle so as to prevent the operating handle from moving beyond the second position and to permit the operating handle to move to a third position; and at least one retainer in operative communication with each projection and the operating handle so as to retain each projection in that projection's associated opening in the mullion when the operating handle is in one of the first and second position and to permit axial withdrawal of each projection from that projection's associated opening when the operating handle is in the third position.

2. The louvre blade assembly of claim 1 wherein the releasable limit device and at least one control bar are in contact when the operating handle is in the second position.

3. The louvre blade assembly of claim 2 wherein the releasable limit device extends from within the mullion to an externally accessible release member to free the releasable limit device from limiting the extent of movement of the control bars.

4. The louvre blade assembly of claim 3 wherein the releasable limit device includes a headed fastener located through an opening in the mullion to engage between the control bars and into a structure with which the mullion is to be mounted.

5. The louvre blade assembly of claim 1 wherein each projection includes a pivot boss rotatably engaged in an opening in the mullion, the louvre blade mount further including a restrictor to restrict the pivot boss to substantially only rotational movement relative to the mullion and to permit a movement other than rotational movement when the operating handle is at the third position.

6. The louvre blade assembly of claim 5 wherein the restrictor includes a lateral projection from the pivot boss which is engageable through a recess in the opening.

7. The louvre blade assembly of claim 6 wherein the pivot boss includes a pair of bosses that project in an axial direction relative to the pivot boss and are freely and pivotally engaged in openings in respective of the control bars.

8. The louvre blade assembly of claim 6 wherein the restrictor includes a plurality of lateral projections and the mullion includes a plurality of recesses that correspond one to one to the plurality of lateral projections.

9. A louvre blade assembly comprising:

a mullion fixed with a window surround;

two control bars movably mounted within the mullion;

an externally accessible operating handle coupled to the control bars for movement of the control bars, the operating handle being movable between first and second positions;

a plurality of openings in the mullion;

a plurality of louvre blade mounts each having a boss portion rotatably located in a respective opening;

a pair of projections extending from the boss portion, each projection removably located in an aperture in a respective of the two control bars;

a releasable limit device which, when released, permits the operating handle to move to a third position; and at least one retention member which prevent the boss of a louvre blade mount from being axially removed from the opening in the mullion except when the operating handle is in the third position.

10. The louvre window of claim 9 wherein the mullion includes a slot, the slot having a first portion of the operating handle extending there through, the first portion of the operating handle being fixedly pivotally coupled to one of the control bars and a link member fixedly pivotally coupled to the first portion of the operating handle and the other of the control bars.

11. The louvre window of claim 9 wherein the releasable limit device is a headed fastener engaged through a fastener opening in the mullion to locate between the two control bars and thereby prevent movement of the control bars to a position which corresponds to the operating handle being in the third position.

12. The louvre window of claim 11 wherein the mullion further includes a plurality of openings for fasteners to fasten the mullion to the window surround.

* * * * *